United States Patent [19]

Braaten

[11] 4,293,746

[45] Oct. 6, 1981

[54] FOOT OPERATED CONTROL UNIT

[76] Inventor: Ronald J. Braaten, P.O. Box 161, Woodstock, Conn. 06281

[21] Appl. No.: 963,453

[22] Filed: Nov. 24, 1978

Related U.S. Application Data

[63] Continuation of Ser. No. 765,896, Feb. 7, 1977, abandoned.

[51] Int. Cl.[3] ..... H01H 3/14; G05G 1/14

[52] U.S. Cl. ..... 200/86.5; 74/478; 74/512

[58] Field of Search ..... 74/512, 513, 514, 560, 74/478; 338/108, 215, 153; 200/86.5

[56] References Cited

U.S. PATENT DOCUMENTS

| | | | |
|---|---|---|---|
| 1,461,380 | 7/1923 | Cole | 74/478 |
| 1,551,493 | 8/1925 | Lawson | 74/513 |
| 2,103,557 | 12/1937 | Sawdey et al. | 338/153 |
| 2,330,385 | 9/1943 | Rubissow | 74/513 |
| 2,644,868 | 7/1953 | Locey | 200/865 |
| 2,753,709 | 7/1956 | Beck | 74/478 |
| 2,831,367 | 4/1958 | Reilly | 74/513 |
| 2,863,329 | 12/1958 | Montgomery | 74/513 |
| 2,863,962 | 12/1958 | Letteney | 200/86.5 |
| 3,359,821 | 12/1967 | Beardsley et al. | 74/512 |
| 4,046,049 | 9/1977 | Luce et al. | 338/153 |

FOREIGN PATENT DOCUMENTS

| | | | |
|---|---|---|---|
| 106501 | 2/1943 | Sweden | 338/108 |
| 511837 | 8/1939 | United Kingdom | 74/513 |
| 1449862 | 9/1976 | United Kingdom . | |
| 3703698 | 11/1972 | U.S.S.R. | 338/108 |

*Primary Examiner*—Kenneth Dorner

*Attorney, Agent, or Firm*—Prutzman, Kalb, Chilton & Alix

[57] ABSTRACT

A foot operated control unit is provided with a base to be placed or fixed in non-sliding engagement on a floor or other supporting surface, and the actuating member is a cover mounted for sliding movement on the base. The cover is dimensioned so that the operator can place his foot on the top thereof and by pressing forwardly or rearwardly thereon, slide the cover longitudinally of the base. Relative movement of the cover and base is utilized to function one or more control elements such as a valve, switch, rheostat or the like mounted on the base.

6 Claims, 6 Drawing Figures

FOOT OPERATED CONTROL UNIT

This is a continuation of application Ser. No. 765,896, filed Feb. 7, 1977, and now abandoned, The present invention relates to an improvement in control units of the type used for controlling the operation of associated power driven devices such as medical and dental equipment, power tools, recording equipment, office machines, and motor driven appliances generally. The invention is more particularly directed to such control units which are foot operated and wherein the control unit is actuated by the foot of the operator to energize or de-energize or vary the speed or power output or similarly control the operation of an associated power driven device.

An object of the invention is to provide a foot operated control unit of the type referred to which has an improved mode of operation rendering the unit easier and less fatiguing to operate and thereby contributing greatly to the comfort of the operator.

A further object of the invention is to provide such a control unit which can be fabricated with a low profile and which requires a minimum of vertical clearance when installed and used.

Another object is to provide a control unit of the type referred to which has increased versatility for providing a variety of control functions and which will produce these functions in an improved manner.

Another object is to provide a foot operated control unit which is less susceptible to accidental or inadvertent operation either by the operator or by extraneous forces such as falling objects. A further object is to provide a foot operated control unit which is easy and economical to fabricate and assemble and comprises a minimum of parts and yet which is of rugged design having a long service life without requiring repair or replacement.

Other objects will be in part obvious and in part pointed out in more detail hereinafter.

A better understanding of the invention will be obtained from the following description and the accompanying drawings of an illustrative application of the invention.

DESCRIPTION OF THE PREFERRED EMBODIMENT

Figures 1, 6:
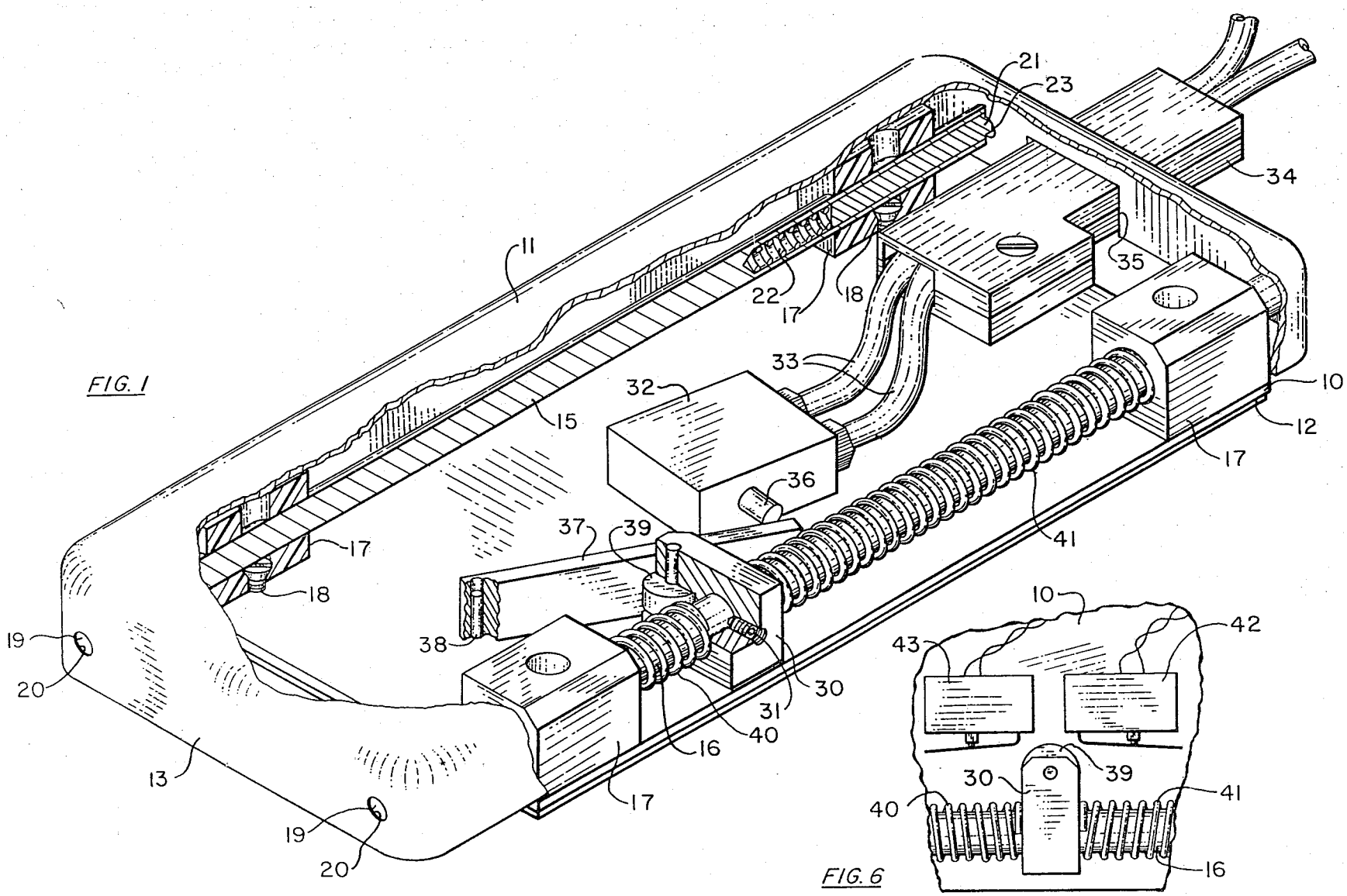
FIG. 1 is a perspective view, partially cut away and partially in cross-section of a foot operated control unit embodying the present invention.
FIG. 6 is a fragmentary view of the base plate of the control unit showing a modified arrangement of the actuating elements.

Referring to the drawings in detail, the exemplary foot operated control unit embodying the invention shown therein comprises a base plate 10 and a cover 11. In use, the unit is adapted to be placed on a supporting surface, usually a floor, and base plate 10 has a resilient pad 12 adhered to its underside, preferably having a tread surface, to effectively prevent the base from sliding on the floor. If desired, of course, the base can be permanently secured to a supporting surface by screws or other fasteners (not shown).

The cover 11 is substantially of the same width as the base plate 10 but considerably longer so that it can extend, for example about one or two inches beyond both ends of the base plate. The cover 11 has a depending skirt 13 extending around its periphery which encloses and protects the interior parts of the unit. The cover which is the actuating member of the control unit is dimensioned to accommodate the foot of the person operating the unit as indicated by the exemplary shoes 14 shown in phantom in FIGS. 3 and 5.

Fixed to the underside of cover 11 at opposite sides thereof are two cylindrical slide rails 15, 16. The slide rails 15, 16 in turn are slidably supported in bearing blocks 17 secured such as by screws 18 adjacent the corners of the base plate 10. By virtue of this mounting, the cover 11 is securely attached to the base plate 10 but is permitted to move linearly and longitudinally relative to the base plate. The amount of movement permitted is limited by engagement of the skirt 13 at the ends of the cover 11 with the bearing blocks 17.

One end of each rail 15, 16 has a fixed integral pin 19 which pins are received in openings 20 in the end wall of the cover skirt 13. The opposite ends of the slide rails, as shown in FIG. 1 in connection with slide rail 15 are provided with a movable pin 21 normally extending outwardly under the influence of spring 22 to engage in an opening 23 in the opposite end wall of the cover skirt 13. As will be apparent, this form of mounting permits easy removal and replacement of the cover requiring only the depressing inwardly of the movable pins 21. This is an obvious advantage as it permits easy access to the interior of the unit for purposes of inspection, adjustment and the like.

Figure 2:
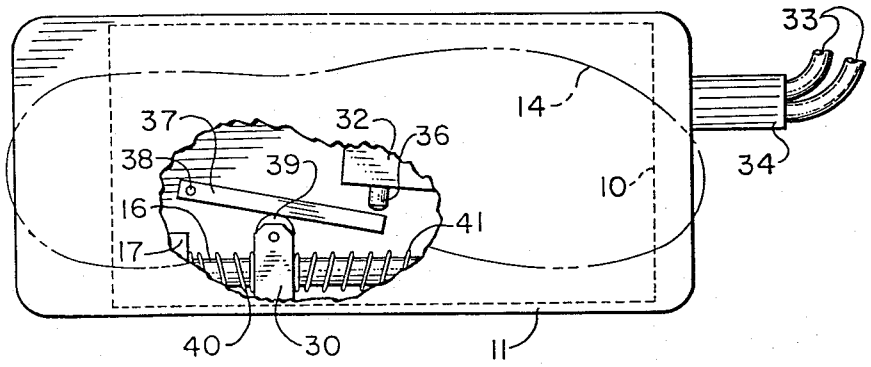
FIG. 2 is a top view of the control unit shown in FIG. 1 with the cover partially cut away to show certain interior operating parts, the control unit being in its normal or at rest position.
Figure 3:
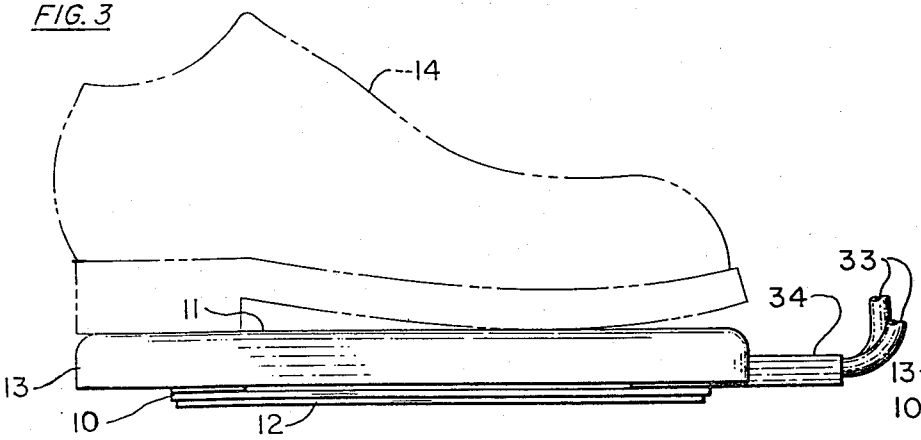
FIG. 3 is a side view of the control unit in the normal or at rest position shown in FIG. 2.

To convert linear longitudinal movement of the cover 11 relative to the base plate into a control function, an actuator 30 is slidably mounted on the rail 16 and secured in selected adjusted position by a screw 31. In the preferred embodiment shown in FIG. 1, the control mechanism 32 is a valve connected to hose conduits 33 for controlling the flow of fluid therebetween. As described hereinafter in connection with the embodiment shown in FIG. 6, the control mechanism may also be a switch and, hence, the term "control mechanism" as used herein is meant to denote a valve or switch. As will be understood, one of the conduits 33 is intended to be connected to a source of fluid under pressure and the other conduit 33 is intended to be connected to a fluid motor of an associated device (not shown) to control the operation thereof. The hose conduits 33, for a portion of their lengths, are housed in a rigid protective casing 34 secured to the base plate 10 and extending outwardly through an opening 35 in the cover skirt 13. Its purpose is to protect the hose conduits from abrasion and to keep the hose conduits straight out so that they will not prevent the cover from sliding to its full forward stroke. The setting of the control valve 32 is determined by the longitudinal position of a plunger 36 projecting outwardly therefrom. Actuation of the plunger 36 is accomplished by a lever 37 pivotally mounted at one end on the base pin 38 and adapted to be engaged at one side by a roller 39 journaled in the inwardly extending nose portion of the actuator 30. The actuator 30, and hence the rails 15, 16 cover 11 are biased to a preselected normal or at rest position (as shown in FIG. 1–3) by opposing springs 40 and 41.

Figure 4:
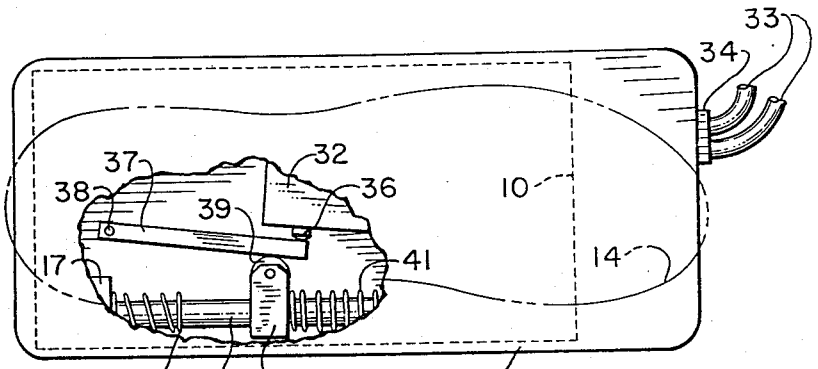
FIG. 4 is a view similar to FIG. 2 but with the control unit in an actuated position.
Figure 5:
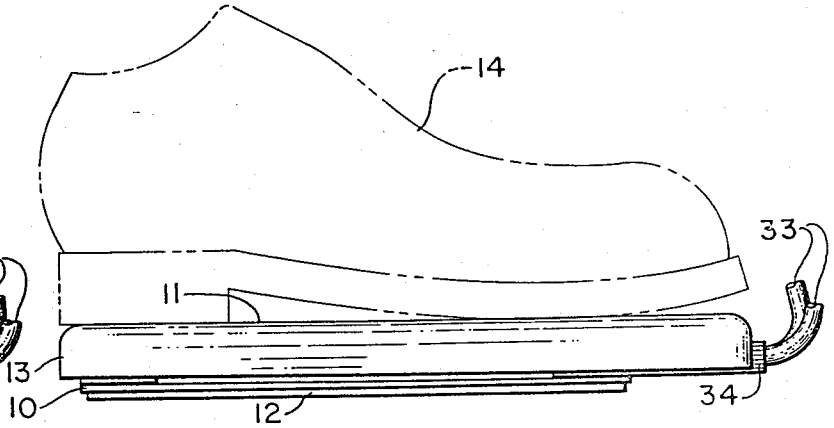
FIG. 5 is a view similar to FIG. 3 but with the control unit in an acutated position.

As will be apparent, forward movement of the cover 11 relative to the base plate 10 (to the right as viewed in FIGS. 1–3), and the accompanying forward movement of the actuator 30 will cause the roller 39 to bear against the lever 37 moving it inwardly and depressing the plunger 36. The fully actuated position is shown in FIGS. 4 and 5. An advantage of using the intermediate lever 37 is that it increases the effective amount of the stroke and applies the force substantially axially to the plunger 36.

In the embodiment just described, only forward movement of the cover 11 relative to the base plate 10 has been used to provide a control function and the amount of actuation of the plunger 36 of the control mechanism is proportional to the amount of forward movement of the cover 11 relative to the base plate 10. This is desirable, for example, when it is desired to vary the speed or power output of an associated apparatus and not merely turn it on and off. However, the cover 11 can also be moved rearwardly of the base plate 10 against the bias of spring 40 to perform an additional control function and the functioning can be with a simple on-off type of control mechanism rather than one which is variable in proportion to the length of the stroke. This is illustrated, for example, in the embodiment shown in FIG. 6 wherein the control elements comprise a pair of Microswitch mechanisms 42, 43 disposed on either side of the actuator 30 when the actuator is in the normal or at rest position. As will be apparent, forward movement of the cover 11 relative to the base plate 10 will cause actuation of the switch 42 while rearward movement of the cover 11 will actuate the switch 43. An inherent advantage of this arrangement is that a positive definitive movement in opposite directions is required to operate the switches and it is impossible to actuate more than one of the switches at one time.

A particular advantage of the foot operated control unit of the present invention is that the foot operation required to move the actuating member or cover is physically easy to achieve and entails a minimum of fatigue. This is particularly true when the operator, such as a dentist, is in a seated position. Furthermore, the length of the operating stroke can be increased and multiple control functions can be provided without making the unit awkward and difficult to operate. The unit can be made with an extremely low profile and even when using conventional control mechanisms such as valves and switches of relatively high capacity, the total height of the unit may be as little as one inch. This means that the operator has to raise his foot only a small amount and furthermore he can put his full weight on the unit, if he wishes, without causing the unit to operate. Since the amount of downward foot pressure is not critical, this also leads to less fatigue and improves the sensitivity of operation. The control unit is also less susceptible to inadvertent or accidental operation since it will not be actuated if merely stepped upon or is struck by a falling object.

As will be apparent to one skilled in the art, various modifications, adaptations and variations of the foregoing specific disclosure can be made without departing from the teachings of the present invention.

I claim:

1. A self-contained foot operated unit for controlling a power circuit of an associated power driven device comprising:

(a) a substantially flat base adapted to be placed on a horizontal supporting surface and having means to retain the base in a fixed position thereon, (b) an elongate foot operated actuating member having an upper surface for receiving and supporting the entire bottom surface of the foot of an operator, (c) bearing means mounting the foot operated actuating member on the base for limited reciprocating forward and backward movement relative thereto only in a linear direction longitudinally of the actuating member responsive to movement of an operator's foot resting on the actuating member, said member together with the base providing an enclosed space therebetween, (d) a control mechanism of the switch or valve type mounted on the base within said enclosed space for connection to the power circuit of an associated power driven device for controlling the operation thereof, and (e) actuating means within said enclosed space and arranged to cooperate with the actuating member for actuating the control mechanism responsive to longitudinal movement of the actuating member relative to the base.

2. A control unit as defined in claim 1 wherein spring means is mounted within said enclosed space between the base and actuating member and biases the actuating member to a predetermined longitudinal position relative to the base.

3. A control unit as defined in claim 1 wherein the actuating member comprises a flat upper plate and has a depending peripheral skirt which encompasses the base.

4. A control unit as defined in claim 1 wherein a plurality of control mechanisms are mounted on the base within said enclosed space for selective actuation responsive to forward and backward movement of the actuating member relative to the base, and opposing spring means are mounted between the base and actuating member for biasing the actuating member to a longitudinal position intermediate the limits of forward and backward movement of the actuating member.

5. A control unit as defined in claim 1 wherein the actuating means for actuating the control mechanism comprises a lever pivoted at one end on the base and having its other end in engagement with the control mechanism, and means on the actuating member engageable with the lever for pivoting the lever responsive to the actuating member.

6. A control unit as defined in claim 1 wherein the bearing means comprises a pair of longitudinally extending slide rails attached to the underside of the actuating member and a plurality of bearing blocks mounted on the base and slidingly supporting the slide rails.

* * * * *